US006752125B2

(12) United States Patent
Bruch et al.

(10) Patent No.: US 6,752,125 B2
(45) Date of Patent: Jun. 22, 2004

(54) METHOD AND APPARATUS FOR CONTROLLING AN ENGINE

(75) Inventors: Kevin L. Bruch, West Lafayette, IN (US); Geoffrey D. Ginzel, Lafayette, IN (US); Michael J. Reinhart, Lafayette, IN (US); Rodney M. Shurman, Lafayette, IN (US)

(73) Assignee: Caterpillar Inc, Peoria, IL (US)

( * ) Notice: Subject to any disclaimer, the term of this patent is extended or adjusted under 35 U.S.C. 154(b) by 26 days.

(21) Appl. No.: 10/234,281

(22) Filed: Sep. 4, 2002

(65) Prior Publication Data

US 2003/0111045 A1 Jun. 19, 2003

Related U.S. Application Data

(60) Provisional application No. 60/342,149, filed on Dec. 19, 2001.

(51) Int. Cl.[7] ..... F02M 51/00
(52) U.S. Cl. ..... 123/399; 123/494
(58) Field of Search ..... 123/399, 704, 123/492, 494, 361

(56) References Cited

U.S. PATENT DOCUMENTS

| | | | | | |
|---|---|---|---|---|---|
| 4,077,219 | A | * | 3/1978 | Melchior et al. | 60/599 |
| 5,526,645 | A | | 6/1996 | Kaiser | |
| 5,735,245 | A | | 4/1998 | Kubesh et al. | |
| 5,791,140 | A | | 8/1998 | Shimasaki et al. | |
| 5,844,342 | A | * | 12/1998 | Miyatani et al. | 310/114 |
| 6,148,627 | A | | 11/2000 | Reason et al. | |
| 6,196,012 | B1 | | 3/2001 | Reason et al. | |
| 6,289,881 | B1 | * | 9/2001 | Klopp | 123/525 |
| 6,432,025 | B1 | * | 8/2002 | Kondo et al. | 477/110 |

* cited by examiner

*Primary Examiner*—Mahmoud Gimie
(74) *Attorney, Agent, or Firm*—Cliff Green

(57) ABSTRACT

Methods and apparatus for controlling an engine having a first maximum power rating based on at least a first predetermined operating condition of the engine. A first sensor transmits a first signal as a function of the engine operating at a predetermined operating condition other than the first predetermined operating condition. A control device receives the first signal and transmits a power signal to the engine as a function of the first signal. The power signal may, by itself, or in conjunction with other signals, cause the engine to produce a quantity of power in excess of the first maximum power rating.

30 Claims, 1 Drawing Sheet

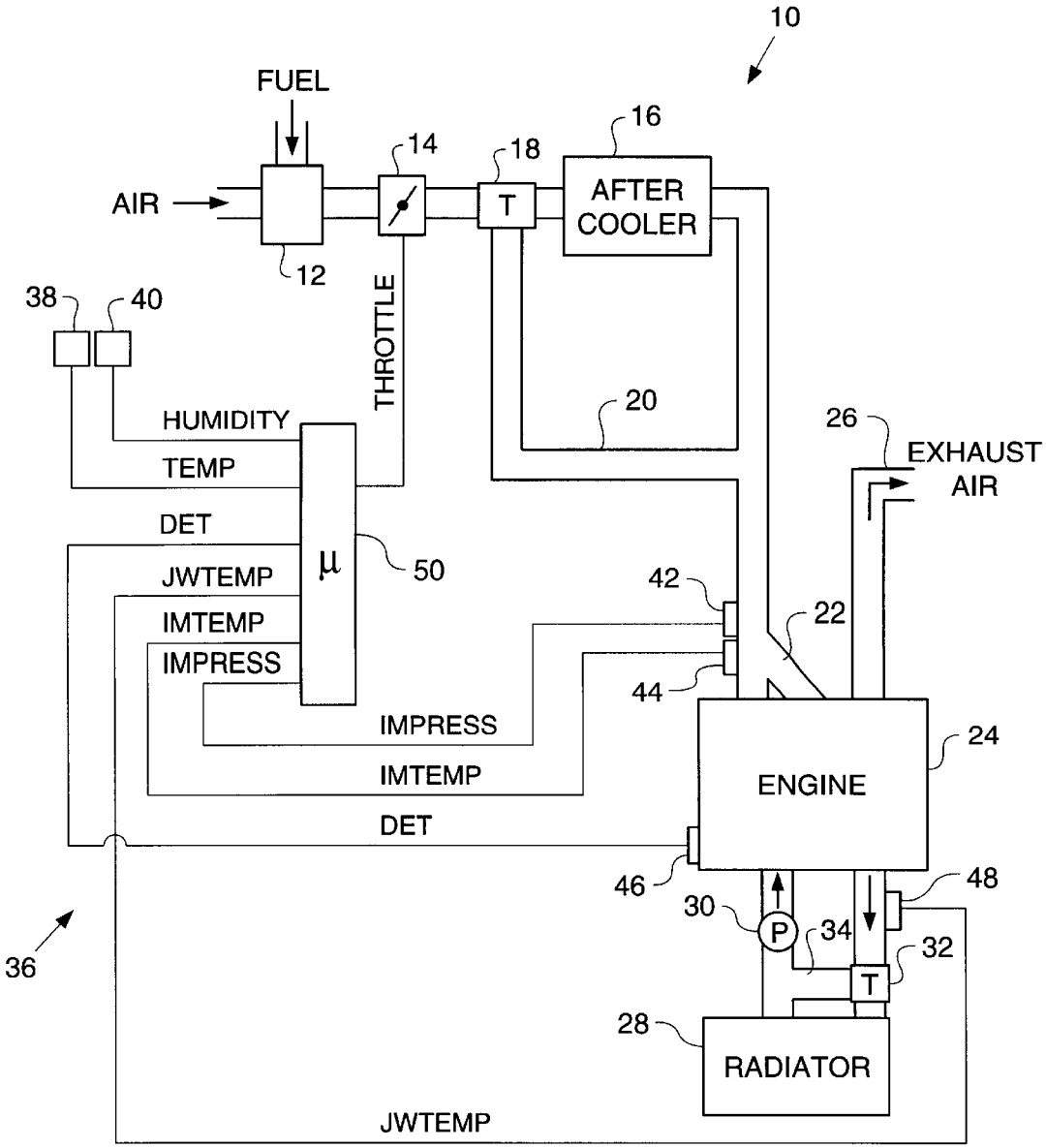
10
FUEL
AIR
12
14
18
T
16
AFTER COOLER
THROTTLE
38
40
HUMIDITY
TEMP
DET
JWTEMP
IMTEMP
IMPRESS
μ
50
20
26
EXHAUST AIR
42
22
44
IMPRESS
IMTEMP
DET
ENGINE
24
46
48
30
P
34
32
T
28
RADIATOR
JWTEMP
36

METHOD AND APPARATUS FOR CONTROLLING AN ENGINE

This application claims the benefit of prior provisional patent application Serial No. 60/342,149 filed Dec. 19, 2001.

TECHNICAL FIELD

This invention relates generally to an engine having a predetermined set maximum power rating based on less than ideal site and ambient conditions, and more specifically to controlling the engine to produce a quantity of power in excess of the predetermined set maximum power rating as a function of engine operating conditions.

BACKGROUND

Many engines are coupled with generators to produce electrical power. These engines are typically configured during manufacture to produce up to a predetermined set power rating. More specifically, an engine controller is normally configured to command the engine to produce up to and no more than the predetermined maximum power rating.

The predetermined maximum power rating of a particular engine is often calculated using worst case operating conditions for the engine. This is because the amount of power that the engine is capable of producing is usually limited by its operating conditions. For example, if the ambient temperature is very warm, e.g., 43 degrees Celsius, the temperature of the air or air/fuel mixture being sent to the combustion chamber cannot be as cool as a day when a substantially cooler ambient air temperature exists. Within a fairly wide range, the temperature of the air or air/fuel mixture being sent to the combustion chamber has a direct impact on engine power capability.

The example in the paragraph above generally covers an operating condition where cooler water to the aftercooler (aftercooler water temperature) results in a power increase because the inlet manifold temperature is reduced. Similarly, other engine operating conditions, such as jacket water temperature, inlet manifold pressure, humidity, and whether detonation is occurring during ignition may all affect combustion, and therefore power production.

Further, many engine controllers limit the power production of an engine to a predetermined set maximum power rating. Thus, even when an engine is operating in better than worst case operating conditions, the engine controller may still use predetermined worst case conditions for calculating the power output. In this instance, the engine typically produces less power than it could, with the additional power producing capabilities of the engine remaining unused.

SUMMARY OF THE INVENTION

The present invention provides methods and apparatus for controlling an engine having a first maximum power rating based on at least a first predetermined operating condition of the engine. A first sensor transmits a first signal as a function of the engine operating at a predetermined operating condition other than the first predetermined operating condition. A control device receives the first signal and transmits a power signal to the engine as a function of the first signal. The power signal causes the engine to produce a quantity of power in excess of the first maximum power rating.

BRIEF DESCRIPTION OF THE DRAWINGS

FIG. 1 shows a block diagram of an engine system according to one embodiment of the invention.

DETAILED DESCRIPTION

FIG. 1 shows a block diagram of an engine system 10 according to one embodiment of the invention. The engine system 10 will be discussed in terms of a natural gas engine, although other types of internal combustion engines, including turbines and diesels could also be used. The engine system 10 typically includes an air delivery system (not shown) that delivers air (e.g., either ambient air or air and some other combustible gas) to an air/fuel mixing device, such as a carburetor 12 or electronic fuel valve. Other types of air/fuel mixing devices known to those skilled in the art could also be used in appropriate embodiments.

A fuel delivery system (not shown) also delivers fuel, e.g., natural gas, to the carburetor 12 by ways known to those skilled in the art. The carburetor 12 mixes the air and fuel, forming an air/fuel mixture.

The air/fuel mixture passes through a restricting device, such as a throttle plate 14. The throttle plate 14 controls the volume of the air/fuel mixture that passes by ways known to those skilled in the art. In embodiments of the invention, the throttle plate 14 location may be varied from what is shown in FIG. 1. For example, it may be after, rather than before an aftercooler.

In embodiments of the invention that include an aftercooler 16, such as a separate circuit aftercooler ("SCAC"), the combustion air/fuel mixture may be cooled, such as by: 1) passing the air/fuel mixture through the inside of a heater exchanger and ambient air passing over the outside (shown in FIG. 1); or 2) a cooled water passing through the inside of the heat exchanger and the contained air/fuel mixture passing over the outside of the heat exchanger core. Either system typically has a thermostat 18 to control the air/fuel mixture temperature to the engine. For SCAC system 1 (generally referred to as Air-toAir Aftercooler (although for gaseous fueled low pressure units it should be more properly be called Air-to-Air/Fuel Mixture Aftercooler), the first thermostat 18 diverts none, some, or all of the air/fuel mixture through the aftercooler for cooling depending on the temperature of the air/fuel mixture at the first thermostat 18. In one embodiment of the invention, the first thermostat 18 is set for 43 degrees Celsius. In other words, the first thermostat 18 will send all of the air/fuel mixture through the aftercooler 16 if the temperature of the air/fuel mixture is greater than 43 degrees Celsius. If the temperature of the air/fuel mixture is less than 43 degrees Celsius, the first thermostat 18 will cause at least some of, and more typically all of the air/fuel mixture to bypass the aftercooler 16, through a first bypass path 20. In other embodiments of the invention there are variations of this type of aftercooler 16 that are not thermostatically controlled and generally do not vary engine power based on ambient conditions.

Both the air/fuel mixture from the aftercooler 16 and the first bypass path 20 typically enter an inlet manifold 22 and a combustion chamber (not shown) of an engine 24. As mentioned above, the engine 24 may be any of a variety of engines known to those skilled in the art, including and not limited to natural gas, turbines, diesel, and gasoline engines.

The second SCAC system described above may operate similarly except the cooling water circuit to the aftercooler 16 is thermostatically controlled. In this embodiment, the air/fuel mixture is not controlled or diverted through the first bypass path 20.

The end result in many prior art engines is that the temperature of the air/fuel mixture to the inlet manifold 22 has been predetermined to a relatively high amount based on generally a worst case expected ambient condition. This method "mechanically" restricts the engine to a less than true maximum power output.

After combustion, the exhaust air and other combustion products exit the engine 24 via an exhaust path 26 by ways known to those skilled in the art.

In embodiments of the invention, a heat exchanger, such as a radiator 28, may be coupled with the engine to reduce the temperature of the engine 24. Other types of heat exchangers known to those skilled in the art may also be used.

Typically water, e.g., jacket water, or a mixture of water and other temperature conductive fluids, are flowed through a jacket (not shown) of the engine 24 via a pump 30. A second thermostat 32 is typically used to make the jacket water bypass the radiator 28 via a second bypass path 34 when the jacket water temperature is below some predetermined temperature, such as 90 degrees Celsius. Other temperatures may be selected as appropriate.

In some embodiments of the invention, the radiator 28 may include portions of the aftercooler 16 by ways known to those skilled in the art. Alternately, the aftercooler 16 may use a separate heat exchanger (not shown, but described above as SCAC system 2).

A throttle plate control system 36 typically controls the volume of the air/fuel mixture that the throttle plate 14 allows to pass, e.g., via the position of the throttle plate 14. In some embodiments of the invention, the throttle plate control system 36 may include an ambient air temperature sensor 38 that determines, e.g., calculates or measures, the ambient air temperature, and transmits a temperature signal TEMP indicative of the ambient air temperature.

In embodiments of the invention the throttle plate control system 36 may include a humidity sensor 40 that determines the relative or specific humidity of the ambient air and transmits a humidity signal HUMIDITY indicative of the humidity.

In embodiments of the invention the throttle plate control system 36 may include an inlet manifold pressure sensor 42 that determines the pressure of the air in the inlet manifold 22 and transmits an inlet manifold pressure signal IMPRESS indicative of the pressure.

In embodiments of the invention the throttle plate control system 36 may include an inlet manifold temperature sensor 44 that determines the temperature of the air or air/fuel mixture in the inlet manifold and transmits a temperature signal IMTEMP indicative of the temperature.

In embodiments of the invention the throttle plate control system 36 may include a detonation sensor 46 that determines when a detonation condition occurs during an ignition of the engine, and transmits a detonation signal DET indicative of the detonation. The detonation sensor 46 may, for example, detect vibrations of the engine, with detonation typically causing different vibration characteristics in the engine than normal ignition events do.

In embodiments of the invention the throttle plate control system 36 may include a jacket water temperature sensor 48 that determines the temperature of the jacket water and transmits a jacket water temperature signal JWTEMP indicative of the jacket water temperature.

A control device, such as a microcontroller or microprocessor 50 may be coupled with one, some, or all of the above sensors to receive their respective signals. The microprocessor 50 processes the respective signals and transmits a throttle position signal THROTTLE to the throttle plate as a function of the one, some, or all of the signals from the sensors. The throttle position signal THROTTLE controls the position of the throttle by ways known to those skilled in the art.

Generally, more power may be produced by the engine 24 when one, some, or all of the following operating conditions exist: jacket water temperature is low, such as less than approximately 99 degrees Celsius, for example; inlet manifold temperature is low; inlet manifold pressure is high; detonation is not occurring; ambient temperature is low; humidity is high; and aftercooler temperature is low. Often these operating conditions will be better than the worst case operating conditions, and therefore allow for more power to be produced than the otherwise predetermined set maximum power rating of the engine 24.

However, many conventional natural gas engines do not take advantage of these better than worst case conditions, and continue to command a throttle position THROTTLE as if the worst case operating conditions did exist, thereby resulting in the delivery of less power from the engine than it is capable of. Further, many conventional natural gas engines have a thermostat for the aftercooler and radiator that prevents the combustion air/fuel mixture temperature or the jacket water from being as low as they could be. For example, a unit with a 54 degrees Celsius thermostat installed in the SCAC aftercooler circuit (version 2 SCAC system) may provide on the order of 60 C inlet manifold air temperature. However on cooler days the water temperature from the SCAC radiator (part of 28) could be lower than 54 C. A lower water temperature in the aftercooler circuit would reduce the inlet manifold air temperature and could increase engine power capability. In this example, however, even if the ambient conditions could cool the aftercooler water to a lower temperature the aftercooler thermostat 18 would still send 54C water through the aftercooler core and thus the inlet manifold air temperature would not change.

Similarly, for version 1 of the SCAC system in a prior art system, if the temperature of the air/fuel mixture is below the rating for the first thermostat 18, the air/fuel mixture may bypass the aftercooler 16, even if the ambient conditions would allow the aftercooler 16 to cool the air/fuel mixture below the rating of the first thermostat 18.

This lost cooling equates to lost power. By selecting a lower temperature thermostat, such as a 32 degrees Celsius, the aftercooler temperature may use this additional cooling capability. Other temperature thermostats may be used as appropriate. The thermostat 32 for the radiator may be selected similarly.

When the microprocessor 50 detects operating conditions that are better than worst case, as indicated by the various signals from the sensors, the microprocessor 50 commands the throttle position to a more open position, thereby allowing the engine 24 to produce power in excess of its otherwise worst case maximum power rating.

Further, with many natural gas engines, the throttle plate 14 is never commanded beyond 90–95% for its worst case maximum power. Thus, typically an extra 5–10% of the air/fuel mixture can be made available to the combustion chamber of the engine 24. This 5–10% may now be used due to the further opening of the throttle plate 14.

INDUSTRIAL APPLICABILITY

In operation, the respective sensors determine the operating conditions of the engine 24. The microprocessor 50 processes the respective signals from the sensors. The microprocessor 50 may signal the equipment that is powered by the engine 24, e.g., the driven equipment, that more power is available. The driven equipment may then request the higher power capability and the microprocessor 50 then commands the throttle 14 to a position as a function of the signals from the sensors and the driven equipment. Unlike many conventional throttle plate control systems, the throttle plate control system 36 may command the throttle position to full (100%) open, or as close thereto as is appropriate when the engine operating conditions are better than worst case. This may result in additional power being available from the engine 24. Further, additional cooling of the air/fuel mixture may be achieved by appropriate selection of the thermostats for the aftercooler 16.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An apparatus for controlling an engine having a first maximum power rating based on at least a first predetermined operating condition of the engine, comprising:

a first sensor operable to transmit a first signal as a function of the engine operating at a predetermined operating condition other than the first predetermined operating condition; and a control device coupled with the first sensor to receive the first signal and to transmit a power signal to the engine as a function of the first signal, the power signal operable to cause the engine to produce a quantity of power in excess of the first maximum power rating.

2. The apparatus of claim 1 wherein the first predetermined operating condition comprises a jacket water temperature of the engine being greater than or equal to a first predetermined value; and the operating condition other than the first predetermined operating condition comprises the jacket water temperature being less than the first predetermined value.

3. The apparatus of claim 1 wherein the first predetermined value comprises approximately 99 degrees Celsius.

4. The apparatus of claim 1 wherein the first predetermined operating condition comprises an inlet manifold temperature of the engine being greater than or equal to a second predetermined value; and the operating condition other than the first predetermined operating condition comprises the inlet manifold temperature being less than the second predetermined value.

5. The apparatus of claim 1 wherein the first predetermined operating condition comprises an inlet manifold pressure of the engine being less than or equal to a third predetermined value; and the operating condition other than the first predetermined operating condition comprises the inlet manifold pressure being greater than the third predetermined value.

6. The apparatus of claim 1 wherein the first predetermined operating condition comprises a detonation condition occurring during an ignition of the engine; and the operating condition other than the first predetermined operating condition comprises the detonation condition not occurring.

7. The apparatus of claim 1 wherein the first predetermined operating condition comprises an ambient temperature being less than or equal to a fourth predetermined value; and the operating condition other than the first predetermined operating condition comprises the ambient temperature being greater than the fourth predetermined value.

8. The apparatus of claim 1 wherein the first predetermined operating condition comprises a humidity being less than or equal to a fifth predetermined value; and the operating condition other than the first predetermined operating condition comprises the humidity being greater than the fifth predetermined value.

9. The apparatus of claim 1 wherein the engine includes an aftercooler, and the first predetermined operating condition comprises a temperature of the aftercooler being greater than or equal to a sixth predetermined value; and the operating condition other than the first predetermined operating condition comprises the temperature of the aftercooler being greater than the sixth predetermined value.

10. The apparatus of claim 9 wherein the sixth predetermined value comprises approximately 54 degrees Celsius.

11. A method for controlling an engine having a first maximum power rating based on at least a first predetermined operating condition of the engine, comprising:

determining when the engine is operating at a predetermined operating condition other than the first predetermined operating condition; and commanding the engine to deliver a predetermined power as a function of the engine operating at the predetermined operating condition other than the first predetermined operating condition, the predetermined power being greater than the first maximum power rating of the engine.

12. The method of claim 11 wherein the first predetermined operating condition comprises a jacket water temperature of the engine being greater than or equal to a first predetermined value; and the operating condition other than the first predetermined operating condition comprises the jacket water temperature being less than the first predetermined value.

13. The method of claim 11 wherein the first predetermined value comprises approximately 99 degrees Celsius.

14. The method of claim 11 wherein the first predetermined operating condition comprises an inlet manifold temperature of the engine being greater than or equal to a second predetermined value; and the operating condition other than the first predetermined operating condition comprises the inlet manifold temperature being less than the second predetermined value.

15. The method of claim 11 wherein the first predetermined operating condition comprises an inlet manifold pressure of the engine being less than or equal to a third predetermined value; and the operating condition other than the first predetermined operating condition comprises the inlet manifold pressure being greater than the third predetermined value.

16. The method of claim 11 wherein the first predetermined operating condition comprises a detonation condition occurring during an ignition of the engine; and the operating condition other than the first predetermined operating condition comprises the detonation condition not occurring.

17. The method of claim 11 wherein the first predetermined operating condition comprises an ambient temperature being less than or equal to a fourth predetermined value; and the operating condition other than the first predetermined operating condition comprises the ambient temperature being greater than the fourth predetermined value.

18. The method of claim 11 wherein the first predetermined operating condition comprises a humidity being less than or equal to a fifth predetermined value; and the operating condition other than the first predetermined operating condition comprises the humidity being greater than the fifth predetermined value.

19. The method of claim 11 wherein the engine includes an aftercooler, and the first predetermined operating condition comprises a temperature of the aftercooler being greater than or equal to a sixth predetermined value; and the operating condition other than the first predetermined operating condition comprises the temperature of the aftercooler being greater than the sixth predetermined value.

20. The method of claim 19 wherein the sixth predetermined value comprises approximately 54 degrees Celsius.

21. A method for determining a power rating for an engine having a first maximum power rating based on a worst case environmental condition of the engine, comprising:

determining when the engine is operating in an environmental condition that is better than the worst case environmental condition; and determining a second maximum power rating as a function of the environmental condition that is better than the worst case environmental condition, the second maximum power rating being greater than the first maximum power rating.

22. The method of claim 21 wherein the worst case environmental condition of the engine comprises a jacket water temperature of the engine being greater than a first predetermined value.

23. The method of claim 21 wherein the first predetermined value comprises approximately 99 degrees Celsius.

24. The method of claim 21 wherein the worst case environmental condition of the engine comprises an inlet manifold temperature of the engine being greater than a second predetermined value.

25. The method of claim 21 wherein the worst case environmental condition of the engine comprises an inlet manifold pressure being less than a third predetermined value.

26. The method of claim 21 wherein the worst case environmental condition of the engine comprises a detonation condition existing, the environmental condition that is better than the worst case environmental condition including a detonation condition not existing.

27. The method of claim 21 wherein the worst case environmental condition of the engine comprises an ambient temperature being greater than a fourth predetermined value.

28. The method of claim 21 wherein the worst case environmental condition of the engine comprises an ambient humidity being less than a fifth predetermined value.

29. The method of claim 21 wherein the worst case environmental condition of the engine comprises an aftercooler temperature being greater than a sixth predetermined value.

30. The method of claim 11, further comprising, commanding the engine to deliver a power in excess of the first maximum power rating and approximately less than or equal to the second maximum power rating when the engine is operating in the environmental condition that is better than the worst case environmental condition.

* * * * *